US006409844B1

(12) United States Patent
Shikata et al.

(10) Patent No.: US 6,409,844 B1
(45) Date of Patent: Jun. 25, 2002

(54) SURFACE-TREATED ARTICLE OF MAGNESIUM OR MAGNESIUM ALLOYS, METHOD OF SURFACE PREPARATION AND METHOD OF COATING

(75) Inventors: Naohiro Shikata, Toyono-gun; Yoshiaki Kondou, Amagasaki; Yukio Nishikawa, Ikeda; Yoshihiko Nishizawa, Kurashiki; Yoshinori Sakamoto, Settsu; Takeshi Fujiwaki, Kurashiki, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/623,218

(22) PCT Filed: Mar. 16, 1999

(86) PCT No.: PCT/JP99/01275

§ 371 (c)(1),
(2), (4) Date: Aug. 30, 2000

(87) PCT Pub. No.: WO99/47729

PCT Pub. Date: Sep. 23, 1999

(30) Foreign Application Priority Data

Mar. 17, 1998 (JP) ..... 10-067116
Feb. 2, 1999 (JP) ..... 11-024956

(51) Int. Cl.[7] ..... C23C 22/07
(52) U.S. Cl. ..... 148/261; 148/275; 148/279
(58) Field of Search ..... 148/261, 275, 148/279

(56) References Cited

U.S. PATENT DOCUMENTS 3,840,481 A * 10/1974 Miller ..... 510/420
4,349,390 A 9/1982 Olsen et al.
4,744,872 A * 5/1988 Kobayashi et al. ..... 204/58.4
4,976,830 A 12/1990 Schmeling et al.

OTHER PUBLICATIONS

Database WPI, Section Ch, Week 8030, Derwent Publications Ltd., London, GB; Class M11, AN 80–52326C XP002900449 & JP 55 076094 A (Shokosha KK), Jun. 7, 1980—see abstract.
Database WPI, Section Ch, Week 9421, Derwent Publications Ltd., London, GB; Class M14, AN 94–174147 XP002900450 & JP 06 116739 A (Mitsui Mining & Smelting Co Ltd), Apr. 26, 1994—see abstract.

* cited by examiner

*Primary Examiner*—John Sheehan
*Assistant Examiner*—Andrew L. Oltmans
(74) *Attorney, Agent, or Firm*—Wenderoth, Lind & Ponack, LLP

(57) ABSTRACT

An article of magnesium or its alloy having a surface layer containing magnesium condensed phosphate and magnesium phosphate, which can be produced by treating an article of magnesium or its alloy with a treating liquid containing 1,000 to 20,000 ppm of alkaline metal ions, 1,000 to 50,000 ppm of condensed phosphate ions, and 100 to 20,000 ppm of borate ions, and having pH of at least 8. The treated article has good corrosion resistance, and a coating can be formed on the surface of the article with good adhesion.

5 Claims, No Drawings

SURFACE-TREATED ARTICLE OF MAGNESIUM OR MAGNESIUM ALLOYS, METHOD OF SURFACE PREPARATION AND METHOD OF COATING

FIELD OF THE INVENTION

The present invention relates to a surface-treated article of magnesium or magnesium alloys, a method of the surface preparation of an article of magnesium or magnesium alloys, and a method of the coating of such an article. In particular, the present invention relates to a method of the surface preparation of the article of magnesium or magnesium alloys (hereinafter referred to as "magnesium article") which can perform the degreasing and chemical conversion treatment of the magnesium article in one step, and a method of the coating of a magnesium article, which is performed in combination with the above surface preparation.

PRIOR ART

Housings of CRTs used in home appliances such as TVs, word processors, personal computers, etc. are made of plastics from the viewpoint of strength, and easiness of production. However, with the rise of concern about environmental quality, there arise some trends towards the replacement of plastics with materials which can be easily recycled.

In the case of plasma displays which are vigorously developed as displays, it is desired to produce their housings with materials having high electromagnetic shielding effects.

Thus, it may be contemplated to produce housings with metals. Metal housings should satisfy various requirements, for example, light weight, sufficient strength, causing no environmental problems, good corrosion resistance, etc. Metals which satisfy such requirements include magnesium and its alloys.

When magnesium and its alloys are used as the materials of housings, the housings are coated to improve their appearances. However, it is necessary to subject the housings to surface preparation (pre-treatment) to improve the adhesion of coatings and corrosion resistance.

Hitherto, the surface preparation of magnesium articles has been carried out by a JIS method or a DOW method, which uses chromium compounds. Since the chromium compounds are toxic compounds, a waste water containing chromium compounds cannot be drained into sewers without sophisticated post-treatment.

JP-A-6-330341 discloses, as a surface preparation method of articles of magnesium or its alloys using no chromium compounds, a method using a zinc phosphate-treatment liquid containing zinc ions, manganese ions, phosphate ions, a fluorine-containing compound and an accelerator for the chemical conversion of a film.

However, this method is not satisfactorily harmless to the environment since the treatment liquid contains heavy metals such as zinc and manganese, and also fluoride ions which make it difficult to treat a waste water.

JP-A-6-116740 discloses a surface-treating method comprising treating an article of a magnesium alloy containing aluminum with a pyrophosphate salt solution and then with the solution of an alkali metal hydroxide.

This method is good since it uses neither toxic materials nor heavy metals, but is not an economically advantageous method since it comprises a number of process steps.

JP-A-5-51679 discloses a method for the formation of a protective coating by anodization comprising the steps of dipping the article of magnesium or its alloy in a low-alkalinity aqueous electrolytic solution containing borate or sulfate anions, phosphoric acid and fluoride or chloride ions and depositing magnesium phosphate and magnesium fluoride or chloride on the surface of the article of magnesium or its alloy while applying a direct current through the article.

This method is not satisfactorily harmless to the environment since it contains fluoride ions which make it difficult to treat a waste water. Furthermore, this method is not advantageous from the viewpoint of costs since it requires apparatuses such as a rectifier, electrodes, etc. to apply a direct current.

The surfaces of magnesium articles, which are produced by die casting or thixomolding, are contaminated with releasing agents, oxide films, greases, etc. Thus, it is necessary to remove such contaminants to adjust the surface conditions. To this end, the surfaces are degreased, pickled, or subjected to the surface adjustment, prior to chemical conversion.

These treating methods have drawbacks such that the number of treating steps is large, the number of items for controlling liquids is large, the amount of waste water is large, and so on. Furthermore, the chemical conversion liquids contain many materials which are controlled from the viewpoint of environmental protections, and thus the load on waste water disposal and influences on the environment are concerned about.

SUMMARY OF THE INVENTION

One object of the present invention is to provide a surface-treated magnesium article having good corrosion resistance, on which coatings can be formed with good adhesion, Another object of the present invention is to provide a method for the surface preparation of a magnesium article, and also a method for the coating of a magnesium article, which can reduce the number of process steps, improve the corrosion resistance of the magnesium article, and have less influences on the environment.

The above and other objects can be accomplished by (1) an article of magnesium or its alloy having a surface layer which contains magnesium condensed phosphate and magnesium phosphate, (2) a method for the surface preparation of an article of magnesium or its alloy comprising treating the article with a treating liquid which contains
1,000 to 20,000 ppm of alkaline metal ions,
1,000 to 50,000 ppm of condensed phosphate ions, and
100 to 20,000 ppm of borate ions, and has pH of at least 8, and (3) a method for coating an article of magnesium or its alloy comprising the steps of:
treating the article with a treating liquid which contains
1,000 to 20,000 ppm of alkaline metal ions,
1,000 to 50,000 ppm of condensed phosphate ions, and
100 to 20,000 ppm of borate ions, and has pH of at least 8,
removing the article from the treating liquid,
washing the article with water,
drying the washed article, and
coating the dried article.

DETAILED DESCRIPTION OF THE INVENTION

Articles to be treated by the method of the present invention are those made of magnesium or its alloys. In particular, such articles are housings of CRT displays for TVs, word processors, personal computers, but are not limited to them.

Such articles can be produced by any conventional methods, for example, sheeting, die casting, and the like.

The compositions of magnesium alloys are not limited, and any magnesium alloys, which are industrially used, may be used in the present invention.

Preferred examples of magnesium alloys include magnesium alloys containing aluminum (e.g. AZ-91A, B and D, etc.).

Examples of condensed phosphate salts, which are contained in a treating liquid used in the method of the present invention, include salts of polyphosphoric acid, metaphosphoric acid, and ultraphosphoric acid. Among them, polyphosphoric acid of the formula: $M_{n+2}P_nO_{3n+1}$ in which n=2, 3, 4, . . . , in particular, polyphosphoric of this formula in which n is 3 is preferable.

The dispersibility of polyphosphate salts in water decreases as the molecular weight of polyphosphoric acid increases. hen the molecular weight of polyphosphoric acid is too low, the unctions of condensed phosphate which the present invention uses, for example, sequestering properties, buffering properties, dispersing properties, etc. may deteriorate.

Condensed phosphoric acid tends to be hydrolyzed in an aqueous medium in a neutral or acidic range to form orthophosphoric acid through tripolyphosphoric acid and pyrophosphoric acid. The rate of hydrolysis depends on pH and a temperature. That is, the rate of hydrolysis increases as pH decreases or as a temperature increases. Thus, a treating liquid used in the present invention has pH of at least 8, preferably in the range between 8 and 11, and a treating temperature is preferably 70° C. or less.

Magnesium articles can be mildly etched when the sequestering properties are used among. the various properties of condensed phosphoric acid. The surfaces of magnesium articles can be cleaned by etching with condensed phosphoric acid, and cleaning effects of optionally used surfactants. The etched amount of magnesium articles increases, as the concentration of condensed phosphate salts increases and a treating time is extended.

In the case of magnesium alloys, if the surface of magnesium alloy articles are excessively etched, smuts, that is, oxides and hydroxides of aluminum, zinc, etc., cover the surfaces of magnesium articles, and thus the adhesion of coatings to the surface may deteriorate.

If the etched amounts of magnesium articles are too large, the sizes of magnesium articles excessively change so that the method of the present invention cannot be adapted to precise parts of today. When the etched amounts of magnesium articles are too low, the surfaces of magnesium articles may not be sufficiently cleaned.

An optimum etched amount is from 0.1 to 20 $g/m^2$, preferably from 0.5 to 10 $g/m^2$. An etched amount is not limited in the above range, since it depends on the surface conditions of magnesium articles.

As described above, condensed phosphoric acid is hydrolyzed in an aqueous medium to form tripolyphosphoric acid and pyrophosphoric acid and finally orthophosphoric acid. A part of pyrophosphoric acid and orthophosphoric acid, which are hydrolyzed products, react with magnesium to form the film of magnesium condensed phosphate and magnesium phosphate. This chemically formed film improves the corrosion resistance of magnesium articles and the adhesion of coatings to magnesium articles.

The amount of such a film is at least 5 $mg/m^2$, preferably in the range between 10 and 100 $mg/m^2$ in terms of P (phosphorus).

The concentration of condensed phosphate ions is in the range between 1,000 and 50,000 ppm, preferably in the range between 3,000 and 30,000 ppm, as described above. When the concentration of condensed phosphate ions is less than 1,000 ppm, the etching effect is low and a treating liquid tends to be easily aged. When the concentration of condensed phosphate ions exceeds 50,000 ppm, an etched amount becomes excessive, and the adhesion of coatings tends to decrease since smuts (oxides and hydroxides of aluminum, zinc, etc.) cover the surfaces of magnesium articles. Furthermore, the too high concentration of condensed phosphate ions is disadvantageous from the viewpoint of costs.

According to the present invention, a treating liquid contains borate ions, which have buffering properties, to improve the corrosion resistance of magnesium articles and to suppress the hydrolysis of condensed phosphate ions.

The concentration of borate ions is in the range between 100 and 20,000 ppm, preferably in the range between 500 and 10,000 ppm. When the concentration of borate ions is less than 100 ppm, a sufficient buffering effect is not attained. When the concentration of borate ions exceeds 20,000 ppm, the effects may not be further improved, and thus such an excessive concentration is disadvantageous from the viewpoint of costs.

Alkali metal ions are counter ions to condensed phosphate ions and borate ions, and include sodium ions, potassium ions, etc. Among them, sodium ions are preferable in the present invention.

The concentration of alkali metal ions depends on the concentrations of phosphate ions and borate ions, pH, etc., and is generally in the range between 1,000 and 20,000 ppm, preferably in the range between 5,000 and 15,000 ppm.

When the concentration of alkali metal ions is less than 1,000 ppm, pH cannot be maintained in a suitable range and thus the stability of condensed phosphate ions may be adversely affected. When the concentration of alkali metal ions exceeds 20,000 ppm, the effects may not be further improved, and thus such an excessive concentration is disadvantageous from the viewpoint of costs.

A treating liquid used in the present invention may contain surfactants, chelating agents, defoaming agents, etc., which are contained in conventional degreasing agents, in a suitable concentration, so as to clean and remove contaminants such as greases or releasing agents which adhere to magnesium articles, sequester hard water components, suppress foaming, and so on.

Surfactants are useful as cleaning-improving agents against greases, etc. and contribute to penetration, emulsifying and dispersing properties.

Surfactants to be used in the present invention include (a) nonionic surfactants, (b) anionic surfactants, (c) cationic surfactants, and (d) ampholytic surfactants.

The concentration of surfactants is not limited since it depends on the surface conditions of magnesium articles, treating methods, etc. Such a concentration is usually in the range between 10 and 2,000 ppm, preferably in the range between 500 and 1,000 ppm.

When the concentration of surfactants is less than 10 ppm, emulsification and dispersibility of greases may decrease, and the adhesion of coatings to the articles may deteriorate. When the concentration of surfactants exceeds 2,000 ppm, the effects may not be further improved, and thus such an excessive concentration is disadvantageous from the viewpoint of costs.

Preferred but non-limiting examples of surfactants are as follows:

(a) Examples of nonionic surfactants include polyoxyethylene alkyl ethers (having 6 to 16 carbon atoms in the alkyl group), polyoxyethylenepolyoxypropylene alkyl ethers (having 6 to 16 carbon atoms in the alkyl group), polyoxyethylene alkylaryl ethers (having 6 to 16 carbon atoms in the alkyl group, and the aryl group being usually a phenyl group), polyoxyethylenepolyoxypropylene alkylaryl ethers (having 6 to 16 carbon atoms in the alkyl group, and the aryl group being usually a phenyl group), polyoxyethylene alkylaminoethers (having 6 to 16 carbon atoms in the alkyl group), polyoxyethylenesorbitan higher fatty acid esters (usually monoesters; the higher fatty acid being a saturated or unsaturated $C_{12}$–$C_{18}$ monobasic fatty acid), polyoxyethylene higher fatty acid esters (mono- or diesters; the higher fatty acid being a saturated or unsaturated $C_{12}$–$C_{18}$ monobasic fatty acid), ethylene oxide-propylene oxide copolymers, and the like.

Examples of nonionic surfactants which are particularly effective for the cleaning purpose are polyoxyethylene hexyl ethers,
polyoxyethylene octyl ethers,
polyoxyethylene decyl ethers,
polyoxyethylene lauryl ethers,
polyoxyethylene octylpheyl ethers,
polyoxyethylene nonylphenyl ethers,
polyoxyethylene decylphenyl ethers,
ethylene oxide-propylene oxide copolymers,
polyoxyethylenepolyoxypropylene nonylphenyl ethers, etc.

The nonionic surfactants may be used independently or in combination of two or more.

(b) Examples of anionic surfactants include higher fatty acid salts (the higher fatty acid usually being a saturated or unsaturated $C_{12}$–$C_{18}$ monobasic fatty acid), alkylsulfate ester salts (having 12 to 18 carbon atoms in the alkyl group), alkylbenzenesulfonate salts (having 11 to 15 carbon atoms in the alkyl group), alkylnaphthalenesulfonate salts (having about 4 carbon atoms in the alkyl group), dialkylsulfosuccinate ester salts (having 10 to 20 carbon atoms in total in two alkyl groups), alkylphosphate ester salts, (having 12 to 18 carbon atoms in the alkyl group), formalin condensed naphthalenesulfonate salts, polyoxyethylene alkylsufonate ester salts (having 8 or 9 carbon atoms in the alkyl group), polyoxyethylene alkylphenylsulfonate ester salts (having 8 or 9 carbon atoms in the alkyl group), etc.

The above salt-form anionic surfactants are usually alkali metal salts. Among them, sodium salts are preferable.

The anionic surfactants may be used independently or in combination of two or more.

(c) Examples of cationic surfactants include alkylamine acetates, alkylamine hydrochloride salts, quaternary ammonium salts, etc.

(d) Examples of ampholytic surfactants include alkyldimethylamine oxides, alkylcarboxymethylhydroxyethylimmidazoriumbetaines, alkylaminocarboxylate salts, etc.

The cationic or ampholytic surfactants may be used independently or in combination of two or more.

The treating liquid to be used in the present invention may additionally contain chelating agents to improve the cleaning effects of the treating liquid.

The concentration of chelating agents is not limited, since it depends on the hardness of water to be used. The concentration of chelating agents is usually in the range between 10 and 2,000 ppm, preferably in the range between 500 and 1,000 ppm. When the concentration of chelating agents exceeds 2,000 ppm, the effects may not be further improved, and thus such an excessive concentration is disadvantageous from the viewpoint of costs.

Preferred but non-limiting examples of chelating agents include aminocarboxylic acids (e.g. nitrilotriacetic acid, ethylenediaminetetraacetic acid, ethylenediaminediacetic acid, triethylenetetramine-hexaacetic acid, etc.) and their salts such as alkali metal salts (e.g. sodium salts, potassium salts, etc.), ammonium salts and lower alkylamine salts (e.g. triethylamine salts); and hydroxycarboxylic acids (e.g. malic acid, citric acid, gluconic acid, heptogluconic acid, etc.) and their salts such as alkali metal salts (e.g. sodium salts, potassium salts, etc.) and lower alkylamine salts (e.g. triethylamine salts).

Among them, hydroxycarboxylic acids and their salts, in particular, alkali metal salts are preferable.

Chelating agents maybe used independently or in combination of two or more.

Defoaming agents are added to suppress foaming in a cleaning process. The concentration of defoaming agents is not limited since it depends on a treating method such as spraying, dipping, etc. The concentration of defoaming agents is usually in the range between 10 and 2,000 ppm, preferably in the range between 500 and 1,000 ppm. When the concentration of defoaming agents exceeds 2,000 ppm, the effects may not be further improved, and thus such an excessive concentration is disadvantageous from the viewpoint of costs.

Preferably, defoaming agents have low solubility in water and can be lightly dispersed in water, or separated from water. Examples of such defoaming agents include sorbitan higher fatty acid monoesters (the higher fatty acid being a saturated or unsaturated $C_{12}$–$C_{18}$ monobasic fatty acid), sorbitan higher fatty acid triesters (the higher fatty acid being a saturated or unsaturated $C_{12}$–$C_{18}$ monobasic fatty acid), adducts of nonylphenol and a few moles of ethylene oxide, ethylene oxide-propylene oxide copolymers having the small number of added ethylene oxide molecules, polyoxyethylenepolyoxypropylene polyhydric alcohol ethers having the small number of added ethylene oxide molecules, etc.

Defoaming agents maybe used independently or in combination of two or more.

The pretreatment of the surface of a magnesium article with a treating liquid may be carried out by allowing the treating liquid in contact with the surface. For example, the pretreatment can be carried out by dipping an article in a treating liquid, spraying a treating liquid on an article, or the combination of dipping and spraying. In addition, any methods which can allow a treating liquid in contact with the surface of an article may be used.

A temperature in surface preparation is usually in the range between room temperature (about 20 to 25° C.) and 80° C., preferably in the range between 40 and 70° C.

In the case of spraying, a spraying time is usually in the range between 1 and 60 minutes, preferably in the range between 2 and 15 minutes.

In the case of dipping, an article is dipped in a treating liquid so that the sufficient amount of the liquid adheres to the surface of the article for a sufficient time for treating the surface. Such a dipping time can be selected by a persons skilled in the art.

After the surface preparation, a magnesium article is washed with water preferably twice or more, although the article may be washed once.

A temperature and a time for washing are not limited. The temperature is not so high and a short washing time is preferable, since magnesium articles react with water even in a neutral water to form brittle magnesium hydroxide. In principle, the washing of pretreated magnesium articles with water may be carried out by substantially the same method as that carried out after chemical conversion in the conventional surface preparation.

After washing with water, water is drained off from magnesium articles, and then the articles are dried, like in the conventional surface preparation.

The surfaces of magnesium articles, which have been subjected to the above surface preparation, carry a layer comprising magnesium condensed phosphate and magnesium phosphate on their surfaces.

After the surface preparation according to the present invention, another chemical conversion treatment may be carried out to further improve corrosion resistance. Such a chemical conversion treatment may be carried out using sodium phosphate, etc., like the conventional methods.

After the surface preparation and optional chemical conversion treatment, magnesium articles are coated.

A coating method is not limited, and any of conventional coatings such as solution type coatings, aqueous coatings, powder coatings, etc. may be used. Electrodeposition coating or powder coating is preferable from the viewpoint of environmental protection. In particular, powder coating is preferable.

It is possible to coat all or a part of the surfaces of a magnesium article.

For example, in the case of the housings of electronic or electric appliances, only the external surface of the housing is coated, while the internal surface may remain uncoated. In the case of the housings of TVs, a coating is sprayed from the side of an opening for installing a CRT screen so that the external and internal surfaces are coated at the same time.

The degreasing and chemical conversion of magnesium articles can be carried out in one step when the treating liquid of the present invention is used. Thus, it is possible to avoid the washing of articles with water, which is carried out between a degreasing step and a chemical conversion step in conventional methods. Accordingly, it is possible to greatly decrease a total coating time and total costs including surface preparation, and the amount of water used for washing can be decreased. Since the amount water used for washing is decreased, a load on waste water disposal can be decreased. Therefore, the present invention is friendly to environments.

EXAMPLES

The present invention will be illustrated by the following examples.

Examples 1–6 and Comparative Examples 1–6

A housing for TV was produced by molding a magnesium material (AZ 91D) and cutting gates.

In Examples 1–6 and Comparative Examples 1–4, an aqueous liquid containing the components in concentrations shown in Table 1 was sprayed on the housing at 60° C. for 3 minutes.

The details of the treating method in Comparative Example 5 were as follows:

A test piece was degreased with trichloroethylene, dipped fin a 3% aqueous solution of hydrogen fluoride for one minute, washed with water, and then dipped in the Dow No. 7 method solution (containing 150 g/l of dichromic acid and 2.5 g/l of magnesium fluoride) at a temperature of 95° C. or higher for 30 minutes.

The details of the treating method in Comparative Example 6 were as follows:

A test piece was degreased with trichloroethylene, dipped 15 in the solution of sodium pyrophosphate (30 g/l) at 30° C. for 3 minutes, washed with water, and then dipped in an aqueous solution of sodium hydroxide at 30° C. for 3 minutes.

The housing, which had been treated as described above, was shower rinsed with water at room temperature for 3 minutes, and then washed with pure water at room temperature. Then, the housing was dried with hot air at 200° C. for 10 minutes.

Subsequently, a powder coating containing a rust-preventive and a curing accelerator ("HAMMERTON SILVER" manufactured by OHASHI Chemical Industries, Ltd.; an epoxy rein-polyester resin base coating) was powder coated on the housing, and baked and dried at 200° C. for 10 minutes. Thus, a coating film having a thickness of about 80 $\mu$m was formed.

The chemically converted surface and coated surface of the housing were subjected to the following measurements and tests:

1) Etched amount

A difference between the weight of a housing prior to the treatment and that after the treatment was defined as an etched amount.

2) Deposited amount of phosphorus

The deposited amount of phosphorus in the formed layer was measured by a X-ray fluorescent analysis.

3) Amount of residual carbon

The amount of residual carbon was measured to evaluate the residue of a releasing agent.

Apparatus: TOC-500A manufactured by SHIMADZU Corporation

Furnace temperature: 500° C.

4) Initial adhesion

A cross-cut test was performed according to JIS K 5400, and the initial adhesion of a coated film was evaluated by the number of remained cross-cut pieces. The percentage of the remaining pieces of 90% or more was regarded as "PASS".

5) Salt spray test

According to JIS Z 2371, a coated film was cut to reach a base metal, a 5% saline was sprayed on the coated film for 8 hours and the spraying was paused for 16 hours, at 35° C., in a one cycle. This spraying and pausing were repeated three cycles. Then, the condition of the coated film were evaluated according to the following criteria:

A: Neither corrosion nor detachment of the coating film were found.

B: Corrosions of less than 2 mm and detachment of the coating film were found.

C: Corrosion of 2 mm or larger an detachment of the coating film were found.

The results are summarized in Table 2.

In Examples 1–6, which used the surface preparation method of the present invention, the deposited amount of phosphorus was 10 mg/m$^2$ or larger, the amount of residual carbon was much less than 100 mg/m$^2$, and the initial adhesion of the coated films and the results of the salt spray test were good.

Results of Comparative Examples 1–6

Comparative Example 1

The etched amount was small and thus the surface cleaning properties on magnesium articles were not good, since the concentration of condensed phosphate ions was low. Furthermore, both the initial adhesion of the coating film and the result of the salt spray test were bad, since the amount of the layer formed by the chemical conversion was small.

pure water. Thus, the number of process steps was large and the amount of waste water was large. Thus, this method was inappropriate from the viewpoint of costs.

TABLE 1

Composition of treating liquids used in Examples and Comparative Examples

| Example No. | Sodium ion (ppm) | Tripoly-phosphate ion (ppm) | Pyro-phosphate ion (ppm) | Ortho-phosphate ion (ppm) | Borate ion (ppm) | Surf-actant (ppm) | Chela-ting (ppm) | Defoam-ing agent (ppm) | pH |
|---|---|---|---|---|---|---|---|---|---|
| Ex. 1 | 3400 | 7500 | 0 | 0 | 100 | 0 | 0 | 0 | 9 |
| Ex. 2 | 4600 | 10000 | 0 | 0 | 200 | 500 | 100 | 100 | 9 |
| Ex. 3 | 4800 | 10000 | 0 | 0 | 1000 | 500 | 100 | 100 | 9 |
| Ex. 4 | 20000 | 40000 | 0 | 0 | 1000 | 500 | 100 | 100 | 11 |
| Ex. 5 | 1000 | 2000 | 0 | 0 | 500 | 1000 | 100 | 100 | 8 |
| Ex. 6 | 5600 | 0 | 10000 | 0 | 1000 | 1000 | 100 | 100 | 9 |
| C. Ex. 1 | 230 | 500 | 0 | 0 | 0 | 500 | 100 | 100 | 8 |
| C. Ex. 2 | 2700 | 60000 | 0 | 0 | 0 | 500 | 100 | 100 | 9 |
| C. Ex. 3 | 7500 | 0 | 0 | 10000 | 0 | 500 | 100 | 100 | 10 |
| C. Ex. 4 | 3000 | 10000 | 0 | 0 | 50 | 500 | 100 | 100 | 17 |
| C. Ex. 5 | Degreasing with solvent + pickling (HF solution) + Dow No. 7 method | | | | | | | | |
| C. Ex. 6 | Degreasing with solvent + pyrophosphoric acid treating liquid + post-treatment with sodium hydroxide | | | | | | | | |

Surfactant: Polyoxyethylene nonylphenyl ether (EO: 11).
Chelating agent: Sodium gluconate.
Defoaming agent: Polyoxyethylene nonylphenyl ether (EO: 5).

Comparative Example 2

The etched amount was large since the concentration of condensed phosphate ions was high. Thus, smuts covered the surface of the magnesium article and had the adverse effects on the initial adhesion of the coating film and also the result of the salt spray test.

Comparative Example 3

The etched amount was not large and thus the surface cleaning properties on magnesium articles were not good, since the treating liquid contained no condensed phosphate ions but orthophosphate ions. Furthermore, the initial adhesion of the coating film and the result of the salt spray test were not good, since the amount of the chemically converted layer was small.

Comparative Example 4

The etched amount was small, the surface cleaning properties on the magnesium surface were not good, and also the initial adhesion of the coated film and the results of the salt spray test were bad, since condensed phosphoric acid was hydrolyzed because of the low pH of the treating liquid.

Comparative Example 5

The initial adhesion of the coated film and the result of the salt spray test were good since the Dow No. 7 method was used. However, the treating liquid contained fluoride ions, chromium ions, etc., and the number of the process steps was large. Thus, this method was inappropriate from the viewpoint of waste water disposal and environmental protection.

Comparative Example 6

The test piece was degreased with a solvent, treated with a pyrophosphate salt, washed with water, post-treated with sodium hydroxide, rinsed with water and then washed with

TABLE 2

| Example No. | Etched amount ($g/m^2$) | Deposited amount of phosphorus ($mg/m^2$) | Amount of residual carbon ($mg/m^2$) | Initial adhesion of coated film | Salt spray test |
|---|---|---|---|---|---|
| Ex. 1 | 3.0 | 20 | 40 | 90 | B |
| Ex. 2 | 5.3 | 35 | 20 | 95 | A–B |
| Ex. 3 | 5.2 | 30 | 15 | 100 | A |
| Ex. 4 | 9.5 | 55 | 10 | 90 | A–B |
| Ex. 5 | 1.0 | 18 | 50 | 90 | B |
| Ex. 6 | 3.4 | 10 | 30 | 90 | B |
| C. Ex. 1 | 0.3 | 2 | 150 | 40 | C |
| C. Ex. 2 | 13.0 | 55 | 10 | 50 | C |
| C. Ex. 3 | 0.1 | 0 | 180 | 40 | C |
| C. Ex. 4 | 2.1 | 10 | 80 | 90 | C |
| C. Ex. 5 | — | — | 10 | 100 | A |
| C. Ex. 6 | — | 5 | 15 | 90 | B |

The amount of residual carbon of a blank: 200 $mg/m^2$.

What is claimed is:

1. A method for the surface preparation of an article of magnesium or its alloy comprising treating the article with a treating liquid which contains 1,000 to 20,000 ppm of alkali metal ions, 1,000 to 50,000 ppm of condensed phosphate ions, and 100 to 20,000 ppm of borate ions, and has pH of at least 8.

2. A method according to claim 1, wherein said treating liquid further contains 10 to 2,000 ppm of a surfactant, 10 to 2,000 ppm of a chelating agent, and 10 to 2,000 ppm of a defoaming agent.

3. A method according to claim 1, wherein said alkai metal ions are sodium ions.

4. A method for coating an article of magnesium or its alloy comprising the steps of:

treating the article with a treating liquid which contains 1,000 to 20,000 ppm of alkaline metal ions, 1,000 to 50,000 ppm of condensed phosphate ions, and 100 to 20,000 ppm of borate ions, and has pH of at least 8, removing the article from the treating liquid, washing the article with water, drying the-washed article, and coating the dried article.

5. A method according to claim 4, wherein said dried article is coated with a powder coating once.

* * * * *